United States Patent [19]

Seibert

[11] 3,964,323

[45] June 22, 1976

[54] DRIVING MECHANISM FOR A RECIPROCATING ENGINE

[76] Inventor: Josef Seibert, Leitgebgasse 2a/11, 1050 Vienna, Austria

[22] Filed: Apr. 22, 1974

[21] Appl. No.: 462,620

[30] Foreign Application Priority Data

Apr. 24, 1973 Austria ..... 3619/73

[52] U.S. Cl. ..... 74/60

[51] Int. Cl.[2] ..... F16H 23/00

[58] Field of Search ..... 74/60

[56] References Cited

UNITED STATES PATENTS 1,867,385 7/1932 Schlenker ..... 74/60

2,650,676 9/1953 Jamotte ..... 74/60

*Primary Examiner*—Samuel Scott
*Assistant Examiner*—Wesley S. Ratliff, Jr.
*Attorney, Agent, or Firm*—Melville, Strasser, Foster & Hoffman

[57] ABSTRACT

The invention relates to a driving mechanism for a reciprocating engine, comprising a casing, a drive shaft which is rotatably mounted in said casing and a transmission means for power transmission from at least one reciprocating piston to said drive shaft.

5 Claims, 13 Drawing Figures

DRIVING MECHANISM FOR A RECIPROCATING ENGINE

Figure 1:
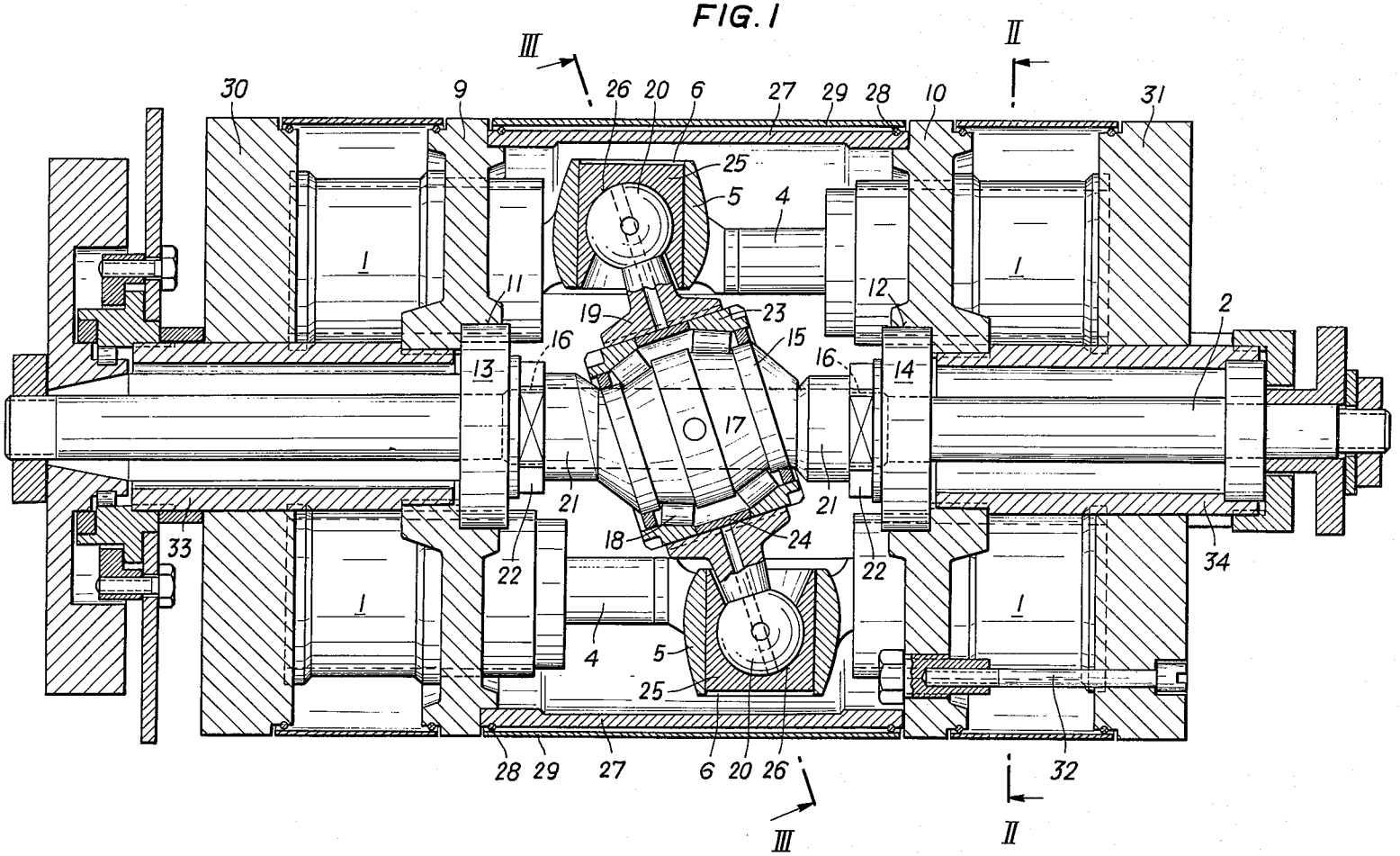

Object of the invention is to provide a driving mechanism for a reciprocating engine working on the swash-plate principle, but requiring neither a crankshaft nor movable piston rods and being applicable for pumps as well as for engines, in particular combustion engines.

According to the invention, the transmission means are formed of at least two ring members being movable in relation to one another around an axis which is inclined towards said drive shaft, said inner ring member being fixedly mounted on said drive shaft and said outer ring member being provided with at least one extension which cooperates with the reciprocating piston of the engine.

The invention relates to a driving mechanism for a reciprocating engine, comprising a casing, a drive shaft which is rotatably mounted in said casing and a transmission means for power transmission from at least one reciprocating piston to said drive shaft.

Driving mechanisms with transmission means formed by a swash-plate serve for the conversion of a reciprocating motion into a rotating motion and vice versa. In the known swash-plate type mechanisms, the cylinder block is mostly arranged rotatable around the drive shaft. This embodiment, taking into consideration the circulating masses, is suitable only for engines with small cylinder blocks, for instance hydraulic engines. For larger engines with stationary cylinder blocks, it is known to position the swash-plate on a Z-shaped crankshaft. The production of such a Z-shaped crankshaft is, however, elaborate and costly.

Object of the invention is to avoid these disadvantages and to provide a driving mechanism for a reciprocating engine working on the swash-plate principle, but requiring neither a crankshaft nor movable piston rods and being applicable for pumps as well as for engines, in particular combustion engines.

According to the invention, the transmission means are formed of at least two ring members being movable in relation to one another around an axis which is inclined towards said drive shaft, said inner ring member being fixedly mounted on said drive shaft and said outer ring member being provided with at least one extension which cooperates with the reciprocating piston of the engine.

In this embodiment, the reciprocating motion of the piston via the extension effects a rotating motion of the transmission member which is transmitted to the inner ring member by means of a rolling motion, the inner ring member causing the drive shaft to rotate. The extensions in this execute a linear movement in the moving direction of the piston and a rotating movement around their axis which is inclined towards the drive shaft. The drive shaft does not perform a wobbling motion, so that there is relatively little wobbling mass.

Preferably, the two ring members are movable in relation to one another by means of a roller bearing the axis of which is inclined towards said drive shaft.

The bearing can be constructed as a steep-angle bearing the axis of which is inclined towards said drive shaft.

According to a preferred embodiment of the invention, the extension of the outer ring member is reciprocatably mounted in the piston rod of the reciprocating piston essentially transverse to the moving direction of said piston. This embodiment is particularly practical for fast-running engines in which the piston axis is arranged parallel to the drive shaft. It is of advantage in this when said extension of said outer ring member is pivotably mounted in a sliding member which is reciprocatably mounted in a support member fixed on said piston rod.

In particular in fast-running engines it is possible to replace the construction specified above by at least one extension which is reciprocatably mounted in a bearing which is pivotably connected to said piston rod.

For precise adjustment of the driving mechanism according to the invention, it is of advantage to arrange the two ring members coaxially and adjustable by means of, for instance, a thread, in the direction of their common axis of rotation being inclined towards the drive shaft.

Figure 2:
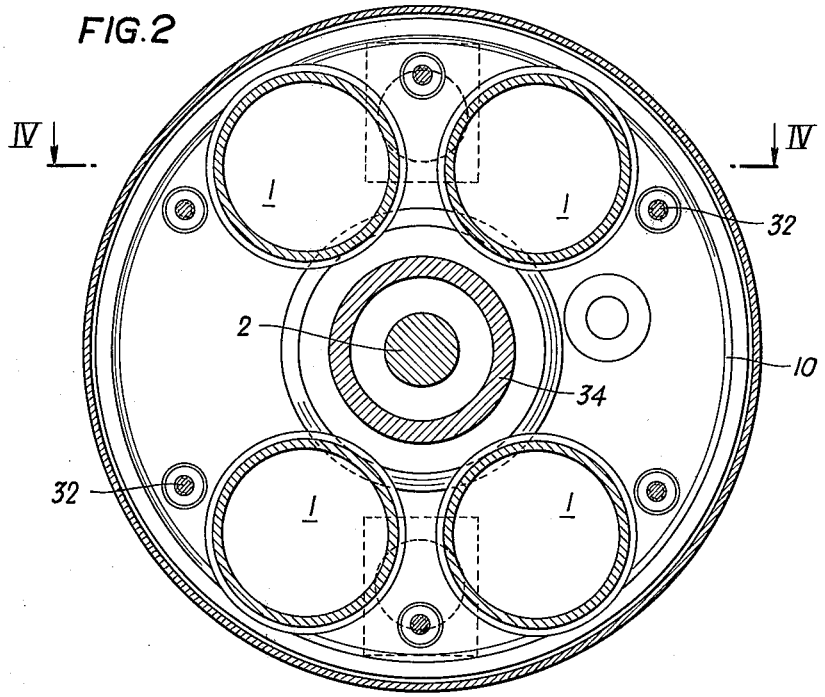
Figure 3:
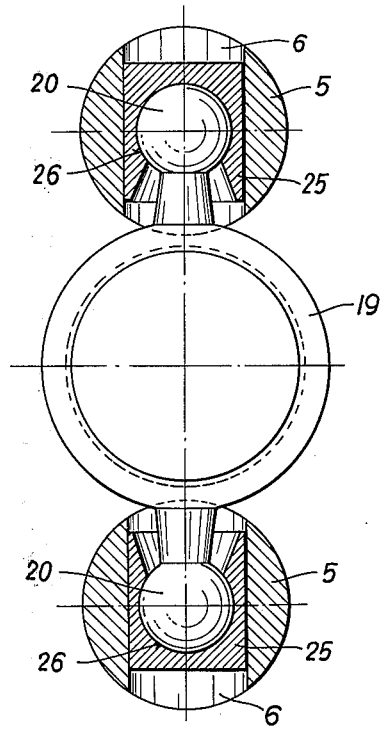
Figure 4:
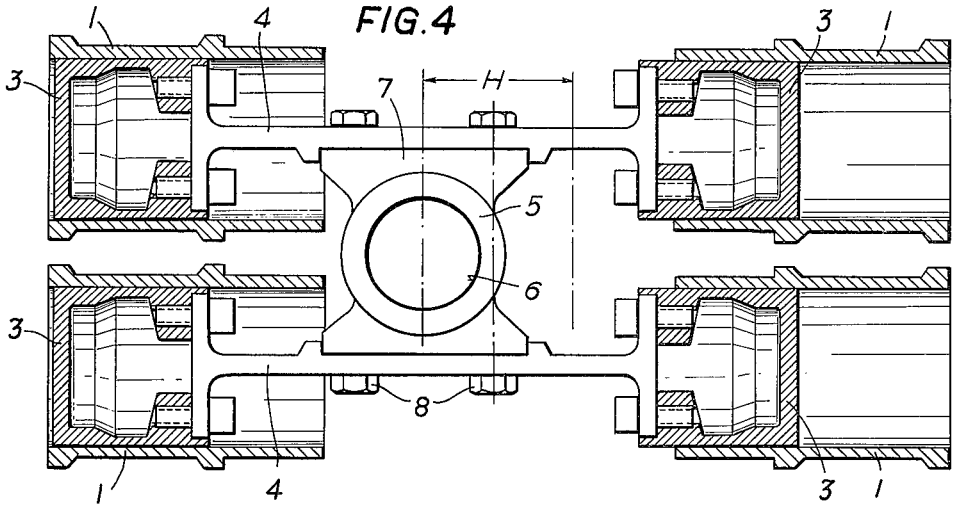
Figure 5:
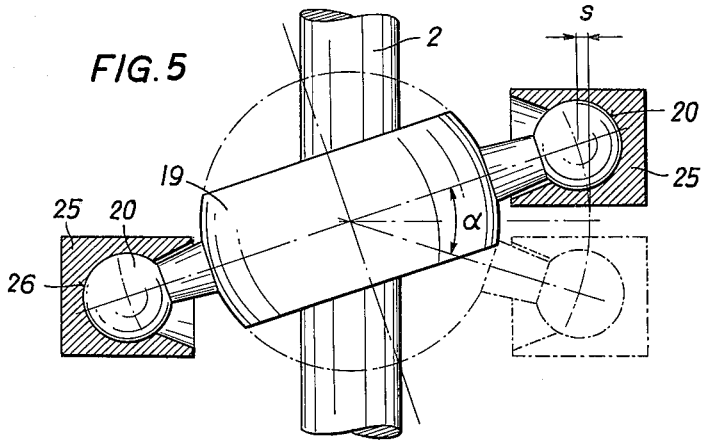
Figure 6:
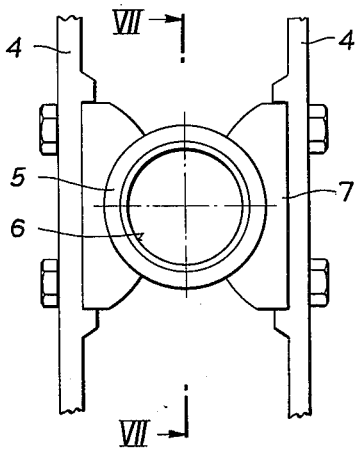
Figure 7:
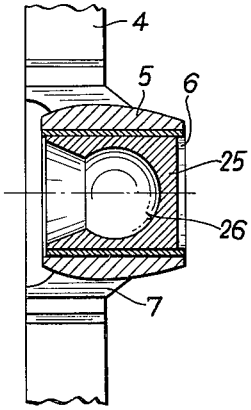
Figure 8:
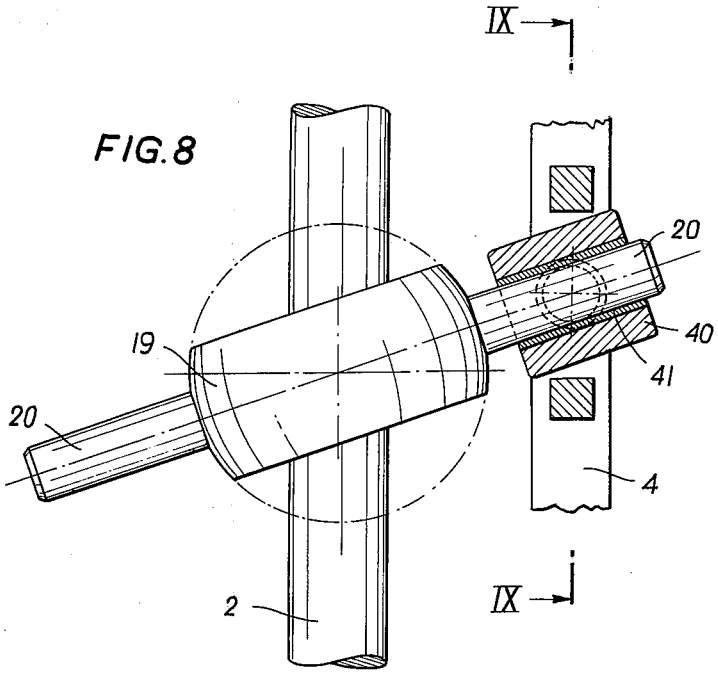
Figure 9:
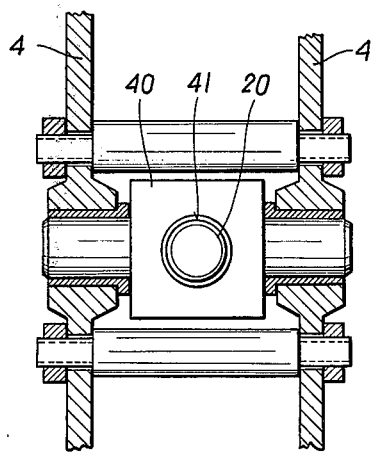
Figure 10:
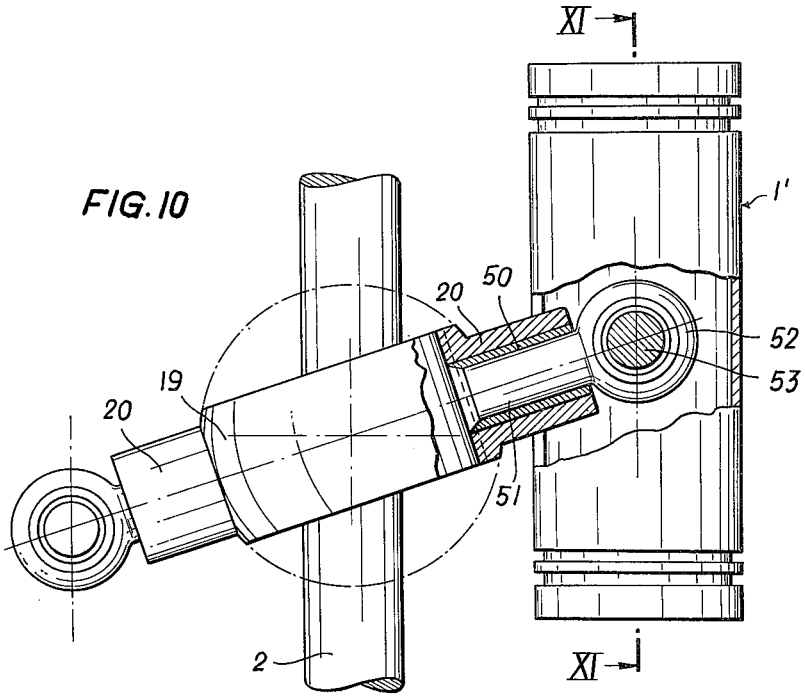
Figure 11:
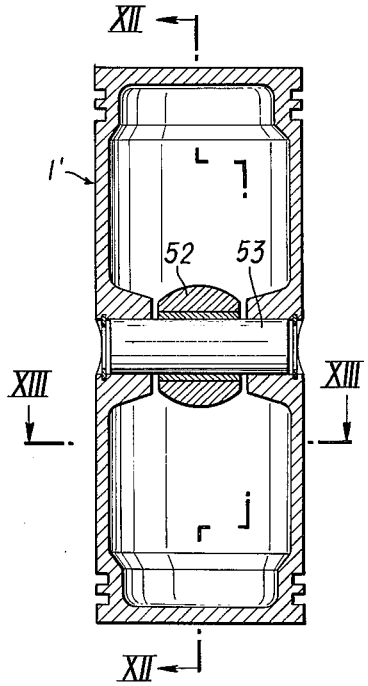
Figure 12:
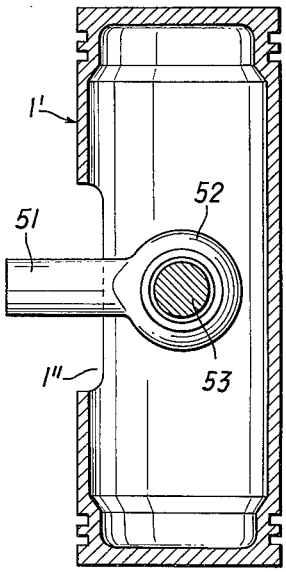
Figure 13:
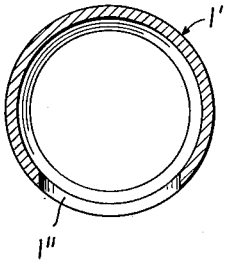

The invention is described in detail by means of the drawing which illustrates one embodiment of the invention and wherein FIG. 1 is a section through a driving mechanism for a reciprocating engine according to the invention having eight cylinders, FIG. 2 is a section along line II—II in FIG. 1 with removed housing cover, FIG. 3 is a section along line III—III in FIG. 1, FIG. 4 is a section along line IV—IV in FIG. 2, FIG. 5 is a diagrammatic view of the drive shaft mechanism of the driving mechanism according to FIG. 1, FIG. 6 a view of the common piston rod for two double cylinders, FIG. 7 a section along line VII—VII in FIG. 6, FIG. 8 a diagrammatic view of a modified driving mechanism, FIG. 9 is a section along line IX—IX in FIG. 8 at center position of the driving mechanism, FIG. 10 is a diagrammatic view of a further embodiment of the driving mechanism, FIG. 11 is a section along line XI—XI in FIG. 10, FIG. 12 is a section along line XII—XII in FIG. 11 and FIG. 13 is a section along line XIII—XIII in FIG. 11.

FIGS. 1 and 2 show a reciprocating engine with eight rigidly mounted cylinders 1 whose driving mechanism is arranged according to the present invention. The cylinders 1 are arranged paraxially in relation to a drive shaft 2 of the driving mechanism of the reciprocating engine, with two each of the cylinders opposing one another in such a manner, in relation to a plane vertical to the axis of rotation of the drive shaft, that their axes are in alignment. The pistons 3 of these opposing cylinders 1 with the stroke H are rigidly connected to one another by means of a piston rod 4. The common piston rods 4 of two each pairs of cylinders arranged on one side of the drive shaft 2 are connected to each other by means of a rodlike support member 5 which has a cylindrical bore hole 6 whose axis is arranged in the range of the longitudinal center of the piston rod 4 and positioned essentially vertical to the cylinder bore. For this purpose, the support member 5 is provided on both sides with flange-like extensions 7 to which the piston rods 4 are fixed by means of screws 8.

As particularly seen from FIG. 2, four each of the cylinders 1 are stationarily positioned in one each base plate 9 and/or 10 extending substantially vertically in relation to the cylinder axes and being provided with central bores 11, 12 in order to receive steep-angle bearings 13, 14 for bearing of the drive shaft 2. The drive shaft 2 is of non-cranked shape throughout and has in its longitudinal center a collar-like lug 15 of a diameter slightly larger than that of its remaining parts, with a thread 16 being attached to each end of the lug 15.

The transmission means of the reciprocating engine which is torsion-fixed to the collar-like lug 15 of the drive shaft 2 essentially comprises an inner ring member 17 pulled over the drive shaft 2, a steep-angle bearing 18 with an axis of rotation inclined towards the drive shaft 2 mounted on this ring member 17, and an outer ring member 19 provided with two extensions 20. The inner ring member 17 is fixedly mounted on the drive shaft 2 by means of nuts screwed onto the threads 16 under interposition of washers 21 and has a stepped or profiled outer circumferential surface whose axis is inclined towards the drive shaft 2. Circumferential sections of this surface form running tracks for the taper rolls in the steep-angle bearing 18. The outer ring 23 of the latter is formed of two parts and provided on its outer surface with a thread by means of which it is screwed into a corresponding thread in the internal bore of the outer ring member 19. By this arrangement, the outer ring member 19 can be adjusted in the direction of the axis inclined towards the drive shaft 2 in relation to the inner ring member 17. Between the two parts of the outer ring 23, there is a spacer ring 24 for adjusting the desired bearing clearance.

The extensions 20 of the outer ring member 19 which are facing one another and form a cross beam or T-like yoke with the ring member 19 are of spherical shape and — as shown in FIG. 3 — positioned in one each calotte-shaped recess 26 of a sliding member 25 which is constructed of two halves of a bushing forming a journal bearing in the cylindrical bore 6 of the support member 5. The extensions 20 are thus articulated in relation to the sliding member 25 and the latter is movably guided transverse to the cylinder axes. The lateral displacement is marked with S in FIG. 5. The maximum pivot angle $\alpha$ of the extensions 20 in relation to the drive shaft 2, depending upon the construction, is about 10 to 25°.

Lubrication of the movable parts is effected by means of dry sump lubrication via a bore hole in the ring member 17 which supplies the bearing spaces of the steep-angle bearing 18 with lubricant, in particular with pressure oil. From the steep-angle bearing 18, the lubricant passes through a further bore in the outer ring member 19 or its extensions 20 to the calotte-shaped recesses 26 of the sliding member 25 or to the bore of the support member 5.

The driving mechanism is closed off at all sides, for this purpose, a space casing member 27 is provided between the two base plates 9, 10 which casing surrounds the parts of the driving mechanism and whose axial length determines the distance between the base plates 9, 10. The space casing member 27 is provided with O-rings 28 for a housing mantle 29 consisting of curved sheet metal. The base plates 9, 10 and the cylinders 1 are braced in relation to one another by means of pressure plates 30, 31 and chucks 32, with tube-like support members 33, 34 arranged coaxially to the drive shaft 2 being provided between the base plates 9, 10 and the pressure plates 30, 31.

The inner ring member 17 can optionally have the form of two parts adjustable in relation to one another.

In the modified embodiment according to FIGS. 10 to 13, the extensions 20 of the outer ring member 19 are provided with cylindrical bores 50 in which a sliding member 51 articulated to the piston 1' of the engine is slidably arranged. This sliding member 51, for the purpose of articulation of the piston 1', is provided with a bearing box 52 with a bearing bore positioned substantially transverse to the axis of the cylindrical bore 50 being pierced by a piston pin 53. This embodiment is particularly suitable for double pistons which are provided with a recess 1'' in order to allow the pivot motion of the extensions.

The driving mechanism according to the invention is basically also suitable for use in reciprocating engines with only one cylinder, but for reasons of mass balance, it is practical to use the driving mechanism in engines with two or more cylinders. The driving mechanism can be used upright or horizontally. In an engine with two cylinders, it is practical to arrange these on either side of the drive shaft. In an engine with four cylinders, these can be arranged in pairs on either side of the drive shaft in order to achieve the flattest possible construction, they can optionally be supplied with double pistons. When a short construction is aimed at, the cylinders can be arranged parallel in relation to one another around the drive shaft.

The drive shaft of the driving mechanism according to the present invention can also be formed in such a manner that the torsion-fixed connection with the inner ring member of the transmission means is secured by means of carriers or grippers.

Transmission means is understood to constitute such a means, optionally consisting of several parts, which is provided with at least one element executing a wobbling motion. This element, however, just like the transmission means specified above, must be provided with an axis which is linearly slidable in the moving direction of the reciprocating pistons and going through a rotating motion — which means that it does not perform a wobbling motion itself. The motion is again absorbed by that element which does not perform a wobbling motion itself. This means that those masses of the transmission means actually performing a wobbling motion can be kept to a minimum, which keeps the inertia force of the driving mechanism low.

What I claim is:

1. A driving mechanism for a reciprocating piston engine, comprising a casing, a drive shaft which is rotatably mounted in said casing, and a transmission means for power transmission from at least two coaxially opposed reciprocating pistons fixedly connected to a common piston rod, to said drive shaft, the axis of which is arranged parallel to the axis of the pistons, said transmission means being formed of inner and outer coaxial ring members which are movable in relation to one another by means of a steep angle bearing around an axis which is inclined to said drive shaft, and which are adjustable with respect to each other axially of their common axis, said inner ring member being fixedly mounted on said drive shaft, and said outer ring member being provided with at least one extension which is reciprocably mounted in said piston rod of said reciprocating pistons essentially transverse to the moving direction of said pistons.

2. A driving mechanism for a reciprocating engine, comprising a casing, a drive shaft which is rotatably mounted in said casing and a transmission means for power transmission from at least one reciprocating piston to said drive shaft, said transmission means being formed of at least two ring members which are movable in relation to one another around an axis which is inclined toward said drive shaft, said inner ring member being fixedly mounted on said drive shaft and said outer ring member being provided with at least one extension which is pivotably mounted in a sliding member which is reciprocably mounted in a support member fixed on said piston rod, said extension cooperating with the reciprocating piston of the engine, said sliding member being constructed of two halves of a bushing forming a journal bearing.

3. A driving mechanism for a reciprocating engine, comprising a casing, a drive shaft which is rotatably mounted in said casing and a transmission means for power transmission from at least one reciprocating piston to said drive shaft, said transmission means being formed of at least two ring members which are movable in relation to one another around an axis which is inclined toward said drive shaft, said inner ring member being fixedly mounted on said drive shaft and said outer ring member being provided with two extensions facing one another and integral with said outer ring member in order to form a T-shaped yoke which cooperates with the reciprocating piston of the engine, said inner ring member being provided with an inner bore hole for said drive shaft, said inner bore hole being inclined to the axis of said ring member.

4. A driving mechanism for a reciprocating engine, comprising a casing, a drive shaft which is rotatably mounted in said casing and a transmission means for power transmission from at least one reciprocating piston to said drive shaft, said transmission means being formed of at least two ring members which are movable in relation to one another around an axis which is inclined toward said drive shaft, said inner ring member being fixedly mounted on said drive shaft and said outer ring member being provided with two extensions facing one another and integral with said outer ring member in order to form a T-shaped yoke, said two ring members being adjustable in the direction of their common axis by means of a thread, said outer ring member being provided with at least two single parts which are adjustable one against the other by means of a distance ring.

5. A driving mechanism for a reciprocating engine, comprising a casing, a drive shaft which is rotatably mounted in said casing and a transmission means for power transmission from at least one reciprocating piston to said drive shaft, said transmission means being formed of at least two ring members which are movable in relation to one another around an axis which is inclined toward said drive shaft, said inner ring member being fixedly mounted on said drive shaft and said outer ring member being provided with two extensions facing one another and integral with said outer ring member in order to form a T-shaped yoke, said two extensions being disposed opposite to each other.

* * * * *